United States Patent [19]

Jacobsen et al.

[11] Patent Number: 4,706,864

[45] Date of Patent: Nov. 17, 1987

[54] FASTENER IMPLANTING MACHINE FOR GROUND EROSION COVERS

[75] Inventors: William M. Jacobsen, P.O. Box 241, Palm City, Fla. 33490; Andrew L. Parker, North Miami Beach, Fla.

[73] Assignee: William M. Jacobsen, Palm City, Fla.

[21] Appl. No.: 834,426

[22] Filed: Feb. 28, 1986

[51] Int. Cl.[4] ..... B25C 1/02; B25C 5/11; B27F 7/26

[52] U.S. Cl. ..... 227/109; 227/120; 227/125; 227/126; 227/147

[58] Field of Search ..... 227/109, 120, 125, 126, 227/147

[56] References Cited

U.S. PATENT DOCUMENTS

| | | | |
|---|---|---|---|
| 2,409,049 | 10/1946 | Lang | 227/125 |
| 2,963,706 | 12/1960 | Namanny | 227/147 |
| 4,139,136 | 2/1979 | Catalano | 227/147 X |
| 4,627,563 | 12/1986 | Meyer | 227/147 X |

FOREIGN PATENT DOCUMENTS

| | | | |
|---|---|---|---|
| 3201706 | 9/1983 | Fed. Rep. of Germany | 227/109 |
| 1376987 | 9/1964 | France | 227/132 |

*Primary Examiner*—Howard N. Goldberg
*Assistant Examiner*—Taylor J. Ross
*Attorney, Agent, or Firm*—Oltman and Flynn

[57] ABSTRACT

A foot-operated machine for implanting fastener elements in the ground through an erosion cover on the ground. The machine has a hollow vertical column slidably receiving a vertically reciprocable driver connected to a foot pedal on the outside of the column. A post extends up from the column and carries a top cross piece with hand grips which a person may grasp while standing substantially erect with one foot on the foot pedal. A magazine assembly feeds fastener elements individually in succession into the column to be forced down into the ground when the driver is moved down by pushing the foot pedal down. The magazine assembly has a magazine housing located on the opposite side of the column from the foot pedal, a magazine removably received in the magazine housing and slidably supporting a continuous series of the fastener elements, and a spring-biased follower which urges the fastener elements toward the column. The magazine housing has an access opening enabling manual access to the follower to release it from a lock which can hold it retracted.

14 Claims, 17 Drawing Figures

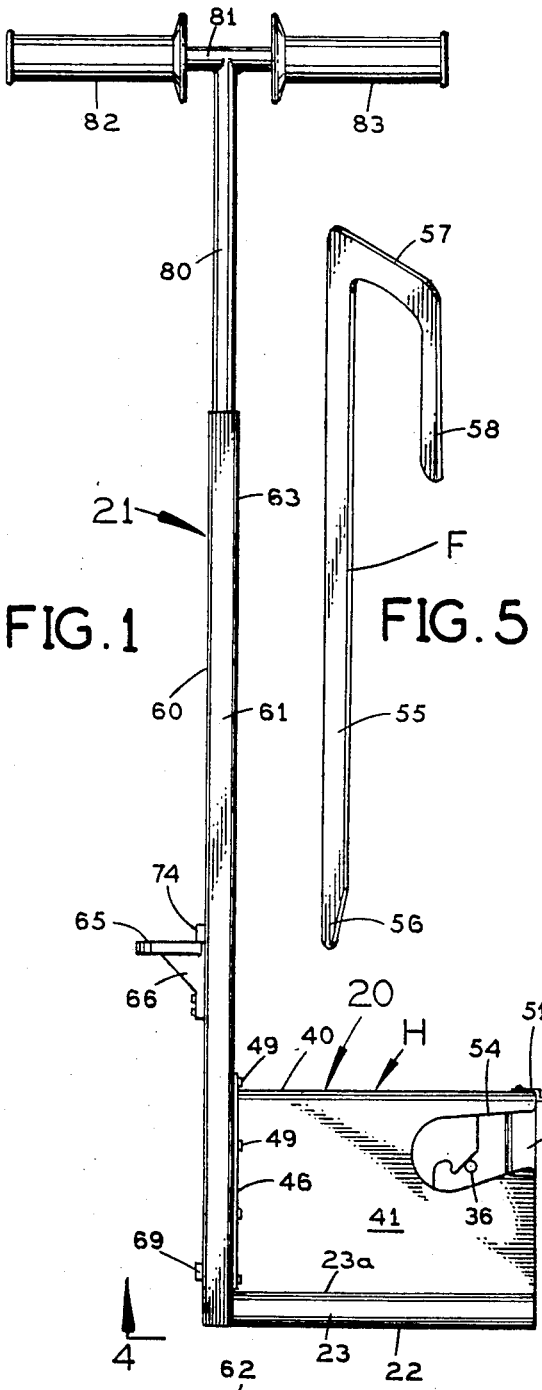
FIG. 1
FIG. 5
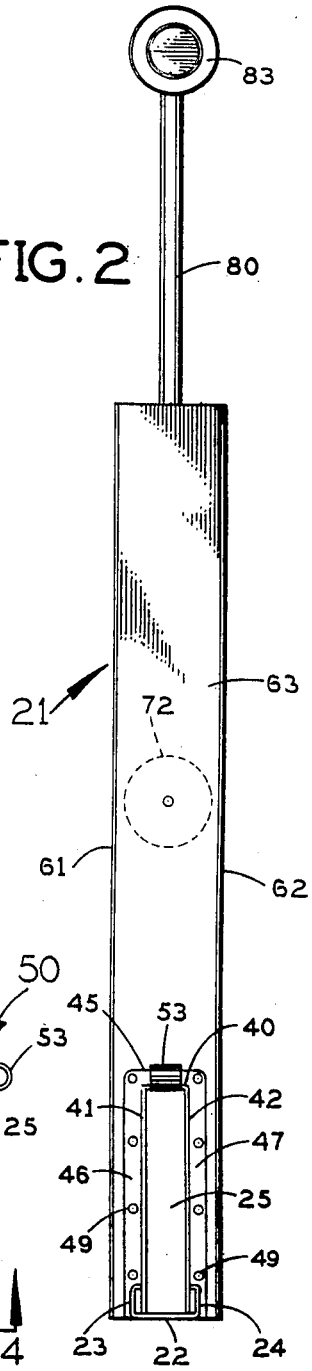
FIG. 2
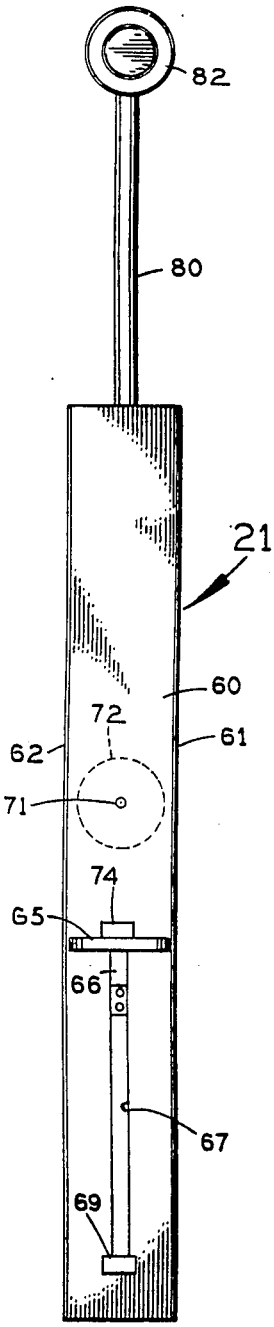
FIG. 3
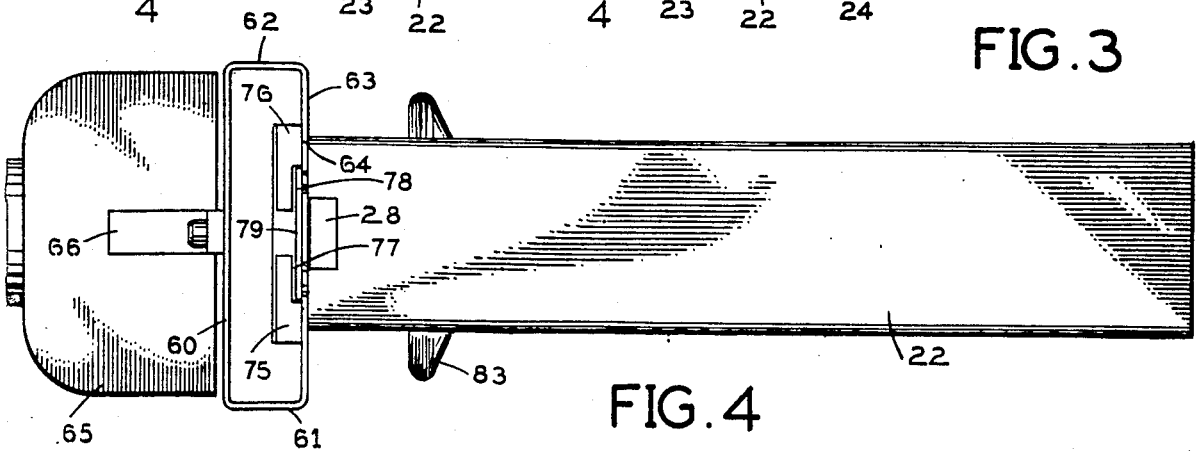
FIG. 4

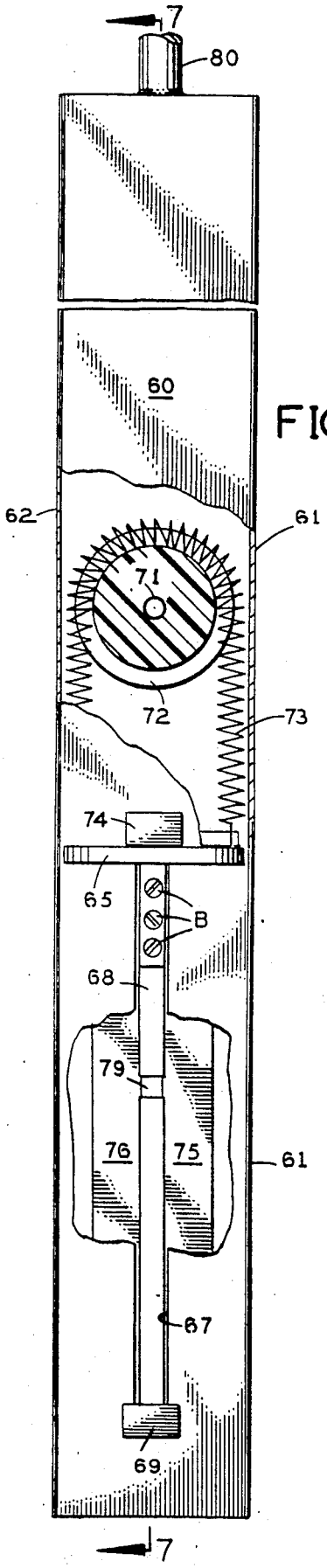
FIG. 6
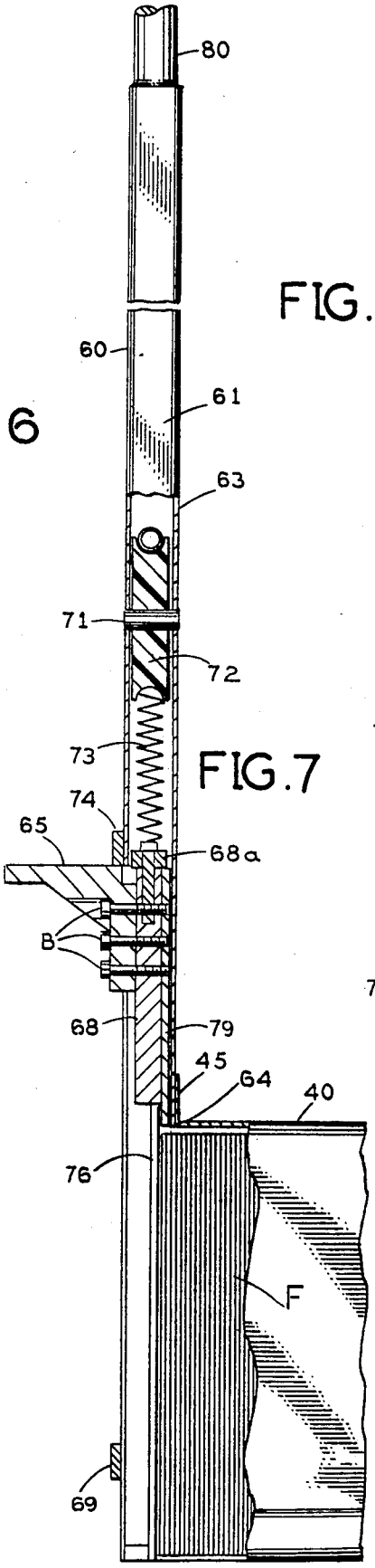
FIG. 7
FIG. 8
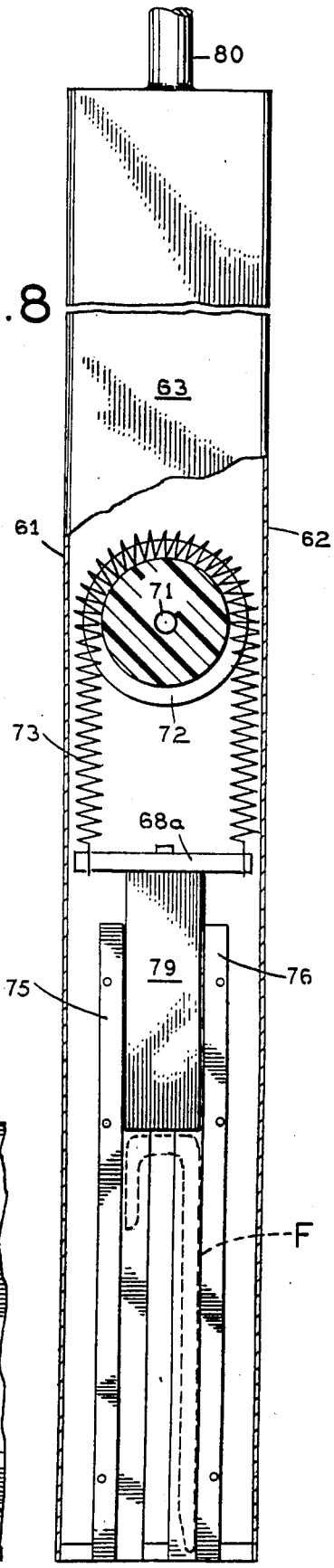

21
22
23
23a
24
24a
25
26
27
28
29
30
31
32
33
34
35
36
37
38
39
40
41
42
43
44
45
46
47
48
49
50
51
52
53
55
57
58
60
61
63
64
65
66
67
68
69
70
71
72
73
74
76
79
10
11
H
P
R
F
B
C

FASTENER IMPLANTING MACHINE FOR GROUND EROSION COVERS

SUMMARY OF THE INVENTION

This invention relates to a machine for implanting fastener elements down through a cover on the ground, particularly a fabric cover for grass seedlings on sloping ground.

A common practice is to lay erosion cloth over grass seedlings, particularly on sloping ground bordering roads and at highway interchanges. The erosion cloth is a fabric cloth designed to hold seeds in the ground and to hold in place mulch products that cover seed in the ground to foster seed germination and growth of seedling roots through the top layer of soil. The erosion cloth must be fastened in place in the ground so that it will not be displaced from the desired location by rain, water runoff or wind.

To hold the erosion cloth in place, the usual practice has been to use a hammer which drives hand held staples down through the erosion cloth and into the ground. Typically, not more than about 200 staples per hour can be inserted by a person using such methods and the user must be on his hands and knees or bent over to operate the hammer.

The present invention is a foot-operated fastener implanting machine which overcomes these difficulties because the user can stand erect, or substantially so, while operating the implanter and can cover more ground without fatigue.

A principal object of this invention is to provide a novel foot-operated machine for implanting fastener elements down through erosion cloth on the ground.

Further objects and advantages of this invention will be apparent from the following detailed description of two presently preferred embodiments which are illustrated schematically in the accompanying drawings.

DESCRIPTION OF THE DRAWINGS

FIG. 1 is a side elevation of a first machine according to this invention;

FIG. 2 is a rear elevation of this machine;

FIG. 3 is a front elevation;

FIG. 4 is a bottom plan view, taken from the line 4—4 in FIG. 1;

FIG. 5 is a perspective view of one of the fastener elements used in the machine of FIGS. 1-4;

FIG. 6 is an enlarged view taken from the front and showing the lower two-thirds of the machine partly in elevation and partly broken away to expose working parts;

FIG. 7 is a vertical section taken along the line 7—7 in FIG. 6;

FIG. 8 is a view similar to FIG. 6 with more parts broken away to expose additional working parts of the machine;

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

Referring to FIGS. 1 and 2, the implanting machine shown there has a magazine assembly 20 at the bottom and a vertical column 21 extending up in front of the magazine assembly and rigidly attached to it.

Figures 9, 10, 11, 17:
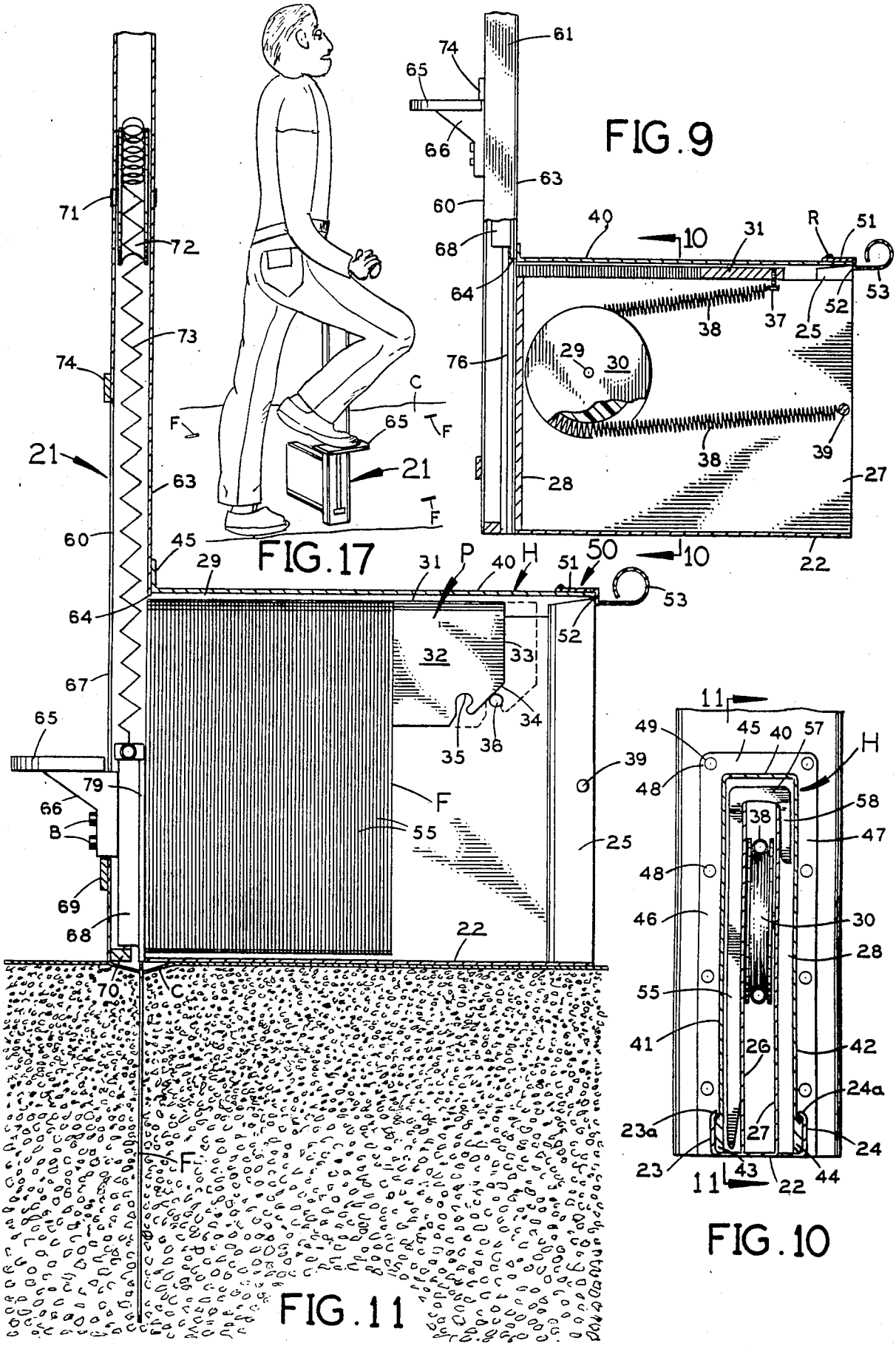
FIG. 9 is a side view of the lower part of the machine with the housing broken away to show the fastener magazine.
FIG. 10 is a vertical cross-section taken along the line 10—10 in FIG. 9.
FIG. 11 is a longitudinal section taken along the line 11—11 in FIG. 10 at one side of the fastener elements in the magazine.
FIG. 17 shows a man operating either of the machines.
Figure 13:
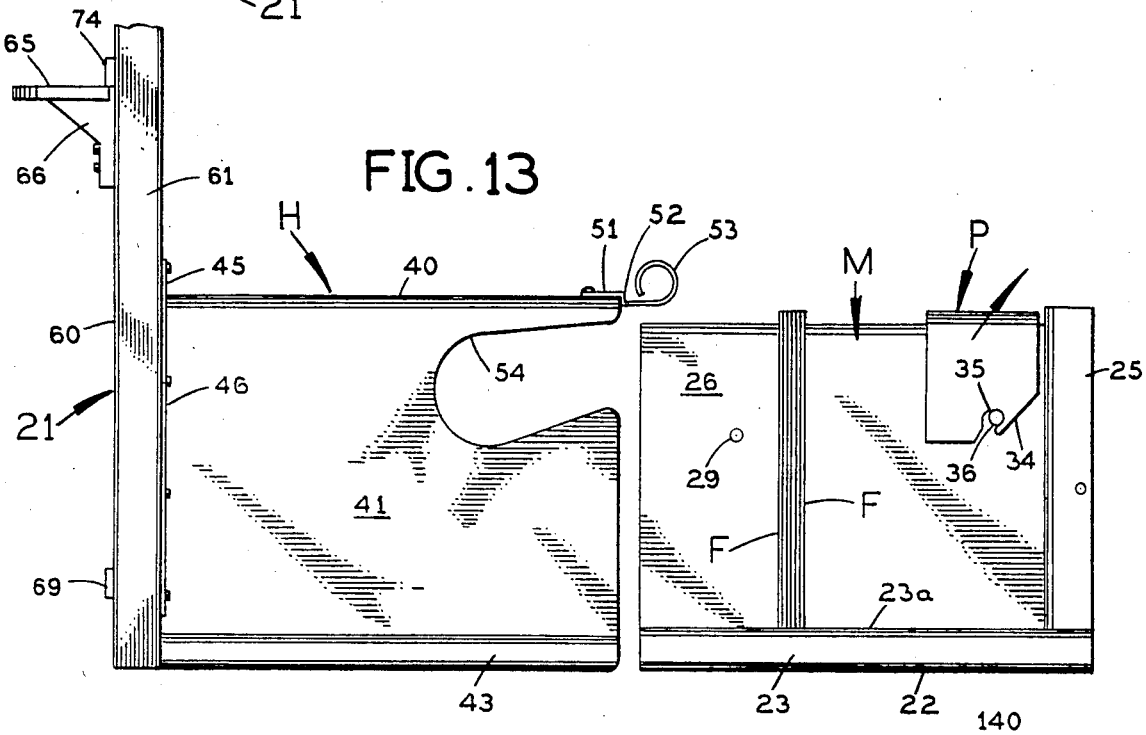
FIG. 13 is a side elevation of the FIG. 12 machine with its fastener magazine taken apart.

Referring to FIGS. 10 and 13, the magazine assembly includes a magazine M having a bottom piece presenting a flat bottom wall 22 and vertical flanges 23 and 24 extending up from the bottom wall on opposite sides and terminating at their upper ends in respective inturned lips 23*a* and 24*a*. At the back end of the magazine (i.e., the end remote from the upstanding column 21) a rigid end piece structure 25 (FIG. 13) extends vertically up from the bottom wall 22. There is a slight clearance between each inturned lip 23a and 24a of the bottom piece and the adjacent side of the end piece structure 25.

The magazine has a pair of flat vertical sides 26 and 27 (FIG. 10) which extend up from its bottom wall 22 along the entire length of the magazine from the back end piece structure 25 to its opposite front end. An upstanding front end wall 28 (FIG. 9) extends between and is joined to the sides 26 and 27 of the magazine at its front end. Both sides 26 and 27 have a substantial clearance inward from the inturned lips 23*a* and 24*a* of the magazine's bottom piece. Toward the front end of the magazine its sides 26 and 27 rotatably support the horizontal axle 29 of a pulley 30.

A follower P of generally channel-shaped cross-section is slidably mounted on the horizontally disposed top edges of the sides 26 and 27 of the magazine. As shown in FIG. 11, this follower has a horizontal top wall 31, a depending side wall 32 extending down from top wall 31 outside the adjacent side 26 of the magazine, and a similar opposite side wall (not shown) which extends down from top wall 31 outside the adjacent side 27 of the magazine. The side wall 32 of the follower has a vertical back edge 33 extending down from its top wall 31, and a downwardly and forwardly inclined edge 34 extending from the lower end of its back edge and leading to a downwardly-facing rounded notch 35. The opposite side wall of the follower is a mirror image of side wall 32, with a notch similar to notch 35. Toward the back end of the magazine a cross pin 36 extends between its opposite sides 26 and 27 and projects outward past each of them for reception in the notch 35 in side wall 32 of the follower and the corresponding notch in the opposite side wall of the follower. When these notches in the follower engage cross pin 36, as shown in phantom in FIG. 11, the follower P is held in its fully retracted position rearward along the magazine.

As shown in FIG. 9, a spring-anchoring screw 37 extends down from the top wall 31 of follower P at its back end midway between its depending opposite sides, such as side 32. A helically wound tension spring 38 is anchored at its upper end on screw 37 and extends forward from it between the opposite sides 26 and 27 of the magazine, around the front of the pulley 30, and from beneath this pulley back to a lower anchor provided by cross pin 39, which is carried by the back end piece structure 25 of the magazine, as indicated in FIG. 11. This spring urges the follower P forward (i.e., to the left in FIGS. 9 and 11, along the top of the magazine.

Figure 12:
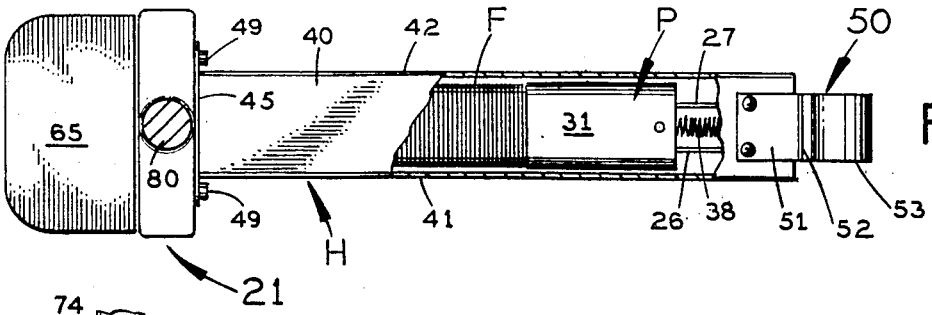
FIG. 12 is a top plan view, with parts broken away for clarity, of a second embodiment of the present invention.

The magazine is slidably engageable with a three-sided rectangular magazine housing H (FIGS. 12 and 13) having a flat horizontal top wall 40 and opposite vertical side walls 41 and 42 extending down from the top wall. The housing side wall 41 is spaced outward from the corresponding side 26 of the magazine, as shown in FIG. 10, and the other housing side wall 42 is similarly spaced outward from the corresponding side 27 of the magazine. The lower end of the housing side wall 41 passes with a slight clearance inside the inturned lip 23*a* on the bottom piece of the magazine. Similarly, the lower end of the housing side wall 42 passes down inside the inturned lip 24*a* on the bottom piece of the magazine. A vertically short, horizontally elongated plate 43 of rectangular cross-section is rigidly attached to the outside of the housing side wall 41 just above its bottom edge. This plate is slidably received between the bottom wall 22 and the inturned lip 23*a* at the inside opf the upstanding flange 23 on the bottom piece of the magazine. Similarly, an identical plate 44 on the outside of the other housing side wall 42 is slidably received between the bottom wall 22 and the inturned lip 24*a* just inside the upstanding flange 24 on the bottom piece of the magazine. With this arrangement, the housing and the magazine can be slidably assembled together (FIG. 1) or slidably separated from one another (FIG. 13) when the user wants unobstructed access to the magazine, such as for inserting fastener elements in the magazine.

At its front end the magazine housing has a flat transverse peripheral flange with a top segment 45 (FIG. 10) and downwardly extending opposite side segments 46 and 47 which are joined respectively to the top wall 40 and the side walls 41 and 42 of the housing. The front end flange on the housing is formed with holes 48 for receiving bolts 49 for attaching the magazine housing H to the back of the vertical column 21.

At its back end the magazine housing H carries a latch 50 (FIGS. 11 and 12), preferably of spring steel. This latch has a flat front segment 51 overlying the top wall 40 of the magazine housing and attached to it by rivets R, bolts or other suitable fasteners. The front segment 51 is joined to a short downwardly extending segment 52 which, as shown in FIGS. 9 and 11, engages the back face of the back end structure 25 of the magazine at the top when the magazine is fully inserted in the magazine housing. A looped handle segment 53 of the latch extends rearward from the lower end of its vertical segment 52.

Whenever the user wants to remove the magazine from the magazine housing, he lifts up the handle 53 until the vertical segment 52 of the spring latch is disengaged from the back end structure 25 of the magazine and is above it. This releases the latching engagement between the magazine housing H and the magazine M, enabling the magazine to be slid rearward out of its housing to the position shown in FIG. 13.

As shown in FIGS. 1 and 13, the magazine housing has an opening 54 in each side extending forward from its back end. Each of these openings enables the user to reach in and engage the follower P to release it from the cross pin 36 on the magazine.

FIG. 5 shows one of the fastener elements F used in this machine. This fastener element has a thin but substantially rigid, elongated vertical leg 55 having a tapered segment 56 at its lower end to facilitate its insertion in the ground. The upper end of the vertical leg 55 is joined to one end of a horizontal top segment 57. A shorter second vertical leg 58 extends down from the opposite end of the top segment 57, parallel to the long vertical leg 55. The entire fastener element is relatively thin but substantially rigid, with opposite flat major faces. Many of these fastener elements can be glued together face-to-face for ease of handling but the glue is not strong enough to prevent the separation of the forward-most fastener element from the ones behind it when the machine is operated to drive the forward-most fastener element down into the ground.

To load the fastener elements in the magazine the magazine is removed from its housing (FIG. 13) and the glued together assembly of fastener elements is slid onto the magazine from its front end. The follower P at this time is locked in its retracted position by the engagement of its notches 35 with the cross pin 36 on the magazine. This stretches the tension spring 38. As shown in FIG. 10, the spacing between the long and short vertical legs 55 and 58 of each fastener element is just slightly greater than the spacing between the outer faces of the sides 26 and 27 of the magazine, so that the fastener elements fit snugly but slidably over the top of the magazine. The longer vertical leg 55 of each fastener extends down almost to the bottom wall 22 of the magazine.

After the magazine has been loaded with fastener elements it is slid forward (to the left in FIG. 13) into its housing H until the spring latch 50 on the housing snaps down behind the back end structure 25 of the magazine, as shown in FIG. 11. This locks the magazine inside the housing.

The user now can reach in through the housing opening 54 to lift the follower P up off the cross pin 36, so that the follower now exerts a forward push on the fastener elements (due to the tension spring 38) and the follower can move forward as successive fastener elements are driven into the ground.

The vertical column 21 in front of the magazine assembly is of hollow rectangular cross-section (FIG. 4), presenting a flat vertical front wall 60, flat vertical opposite side walls 61 and 62, and a flat vertical back wall 63 to which the front end flange 45, 46, 47 of the magazine housing H is bolted. Inside this flange the back wall 63 of the column has a rectangular, vertically elongated opening 64 (FIGS. 4 and 11) which is large enough to pass the fastener elements F from the magazine into the hollow interior of the vertical column 21.

At the front of the vertical column 21, a foot pedal 65 (FIGS. 1 and 3) is rigidly attached to the top of a slide 66, which is slidably received in a vertically extending slot 67 in the front wall 60 of the column. The width of the slot 67 is just slightly greater than that of the slide 66 so that the slide is substantially limited to vertical movement along the slot. The slide 66 is rigidly welded to or formed integral with a vertically reciprocable member 68 (FIG. 11) disposed in the hollow interior of column 21. A plate 69 welded to the front wall 60 of the column at the lower end of slot 67 and a bottom piece 70 on the inside of the front wall of the column provide downward limit stops for the slide 66 and the vertically reciprocable member 68, respectively.

Several inches above the upper end of slot 67 in the front wall 60 of vertical column 21, a cross pin 71 (FIGS. 2, 3 and 11) extends between and is rigidly supported by the front and back walls 60 and 63 of the column. A grooved pulley 72 is rotatably mounted on this cross pin. A helically wound spring 73 extends over the top of pulley 72 (FIG. 6) and has its opposite ends connected to the top piece 68*a* of reciprocable member 68, as shown in FIG. 7. This spring is under tension and it biases the unitary assembly of reciprocable member 68, slide 66 and foot pedal 65 upward. In this position the foot pedal 65 abuts against a plate 74 welded to the front wall 60 of the housing at the upper end of slot 67, so that plate 74 acts as an upper limit stop.

When the user places a foot on top of the foot pedal 65 and pushes down, the unitary assembly of reciprocable member 68, slide 66 and the foot pedal is moved down, overcoming the upward bias exerted by spring 73.

As shown in FIG. 4, two guide pieces 75 and 76 of generally L-shaped cross-section are rigidly attached to the inside face of back wall 63 of vertical column 21. These guide pieces extend on opposite sides of the opening 64 in back wall 63 for the full height of that opening. In its side toward the magazine assembly, guide piece 75 presents a shallow flat recess 77 which is of uniform width and depth for the entire height of this guide piece. Similarly, the other guide piece 76 has a recess 78 whose bottom face lies in the same vertical plane as that of the bottom face of recess 77. Both recesses 77 and 78 are open along the neighboring sides of the guide pieces 75 and 76. The vertical plane of the bottom faces of recesses 77 and 78 is spaced from the inside face of the back wall 63 of column 21 just slightly more than the thickness of a single fastener element F and less than the combined thickness of two of the fastener elements glued together. The coplanar bottom faces of recesses 77 and 78 are exposed to the opening 64 in the back wall 63 of column 21. This back wall has a thickness slightly greater than the thickness of a single fastener element F.

A driver in the form of a rigid thin flat plate 79 is rigidly attached by bolts B to the back of the vertically reciprocable member 68. This plate slidably engages the inside face of the back wall 63 of vertical column 21, as shown in FIG. 7, and its thickness is such that it can pass snugly but slidably down and up along the recesses 77 and 78 in guide plates 75 and 76, as shown in FIGS. 4 and 8.

A vertical post 80 is rigidly attached to column 21 at the latter's upper end and extends up from it. A horizontal cross piece 81 on the upper end of post 80 receives a pair of cushioned hand grips 82 and 83.

In operation, spring 73 normally pulls up the rigid assembly of driver 79, vertically reciprocable member 68, slide 66 and foot pedal 65 to the upwardly retracted position shown in FIG. 9. The spring-actuated follower P in the magazine assembly pushes the entire group of fastener elements F to the left in FIG. 9. The leading fastener element F abuts against the bottom of recesses 77 and 78 in guide plates 75 and 76, respectively, and it is completely past the front end of the magazine. The fastener element immediately behind the leading one is positioned in the opening 64 in the back wall of column 21, substantially in the plane of that wall.

As shown in FIG. 17, the user can grasp the hand grips 82 and 83 and put one of his feet on top of foot pedal 65. When he pushes down on the foot pedal, the rigid assembly of the foot pedal 65, slide 66, vertically reciprocable member 68 and driver 79 moves down. The driver 79 engages the top of the leading fastener element F, forcing it down along the guide plate recesses 77 and 78 and driving its tapered lower end 56 first into the ground, followed by the rest of the fastener element. The downwardly moving driver severs the leading fastener element F from its glued connection to the following one.

FIG. 11 shows the position of the parts at the completion of driving one fastener element F into the ground through an erosion cover C on the ground.

The user now can remove his foot from the foot pedal or relax its downward pressure on the foot pedal, so that the return spring 73 can pull the foot pedal 65, slide 66, vertically reciprocable member 68 and driver 79 up in unison to the retracted, starting position shown in FIG. 9.

As shown in FIG. 17, the user can remain erect while operating the machine, which reduces fatigue. Also, in this standing position the user can move quickly and easily from one fastening position on the erosion cover to the next. Consequently, it is possible for the user in a given time period to fasten a much larger area of the erosion cover on the ground than was possible by previously used techniques. A typical worker can implant at least 5000 fastener elements per hour using the present invention. In addition, the machine is entirely man-powered. It does not require a vehicle either to transport it from one fastening location to the next or to provide power for the fastening operation.

Figure 14:
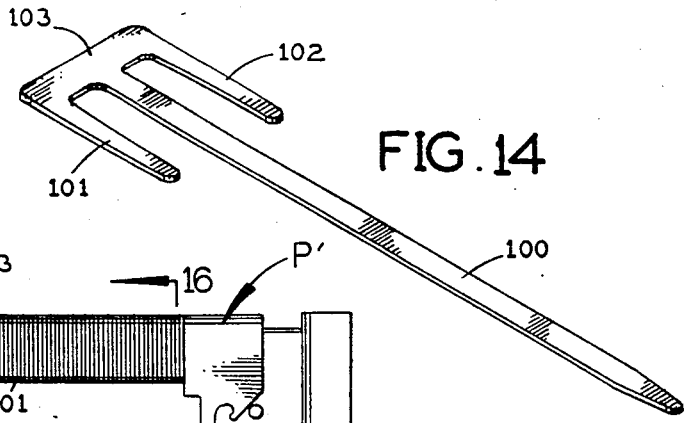
FIG. 14 is a perspective view of a fastener used in the machine of FIGS. 12 and 13.

FIG. 14 shows a different fastener element than the one shown in FIG. 5. It has an elongated central vertical leg 100 and a pair of shorter vertical legs 101 and 102 spaced from the central leg and located on opposite sides of it. The vertical legs are interconnected by a cross-piece 103 at the top. Throughout its extent this fastener is of thin but substantially rigid construction, with flat opposite major faces.

Figure 15:
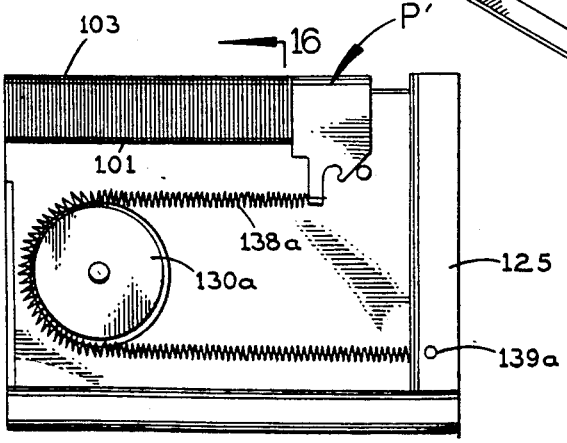
FIG. 15 is a side elevation of the magazine mechanism in this machine.
Figure 16:
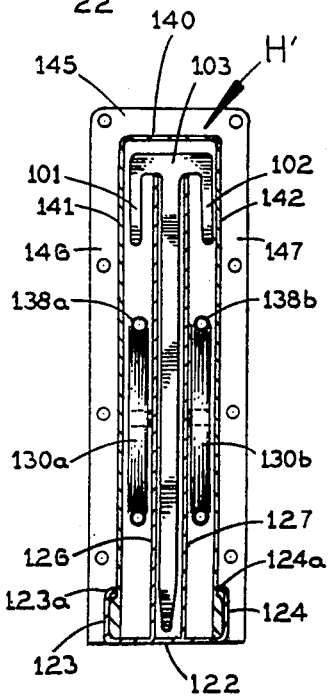
FIG. 16 is a vertical cross-section taken along the line 16—16 in FIG. 15.

FIGS. 15 and 16 show an implanting machine for use with the fastener element shown in FIG. 14. Elements of this machine which correspond to those of the machine shown in FIGS. 1–4 and 5–13 are given the same reference numerals plus 100, so that the detailed description need not be repeated for all of these elements. The upright column and the vertically reciprocable implanting mechanism in it may be substantially the same as shown in FIGS. 1–4, 6–8. 10 and 11. The magazine assembly in FIGS. 15 and 16 is different from the first embodiment because the shape of the fastener element (FIG. 14) is different.

Referring to FIG. 16, the magazine has a bottom piece with a bottom wall 122 and upstanding flanges 123 and 124 on opposite sides which terminate at their upper ends in inturned lips 123*a* and 124*a*. The magazine has opposite side walls 126 and 127 extending vertically up from the bottom wall 122. The side walls are spaced apart enough to snugly but slidably receive the elongated central vertical leg 100 of fastener elements. A series of these fastener elements are glued face-to-face in succession, as shown in FIG. 15, and slidably mounted on the magazine.

Grooved pulleys 130*a* and 130*b* are rotatably mounted on the outside of the uptanding side walls 126 and 127 of the magazine, as shown in FIG. 16. A helically wound tension spring 138*a* (FIG. 15) extends around the front of pulley 130*a*. The lower end of this spring is anchored at 139*a* to the back end piece structure 125 of the magazine. The upper end of spring 138*a* is attached to the follower P', which is slidably mounted on top of the magazine. On the opposite side of the magazine, an identical spring 138*b* (FIG. 16) extends around the front of pulley 130*b* and has its opposite ends connected respectively to the back end piece structure 125 of the magazine and the follower P'. Springs 138*a* and 138*b* urge the follower P' forward along the magazine (i.e., to the left in FIG. 15).

The magazine is slidably insertable into and removable from a magazine housing H' similar to the housing H in the first embodiment. The opposite sides 141 and 142 of housing H' are spaced from the corresponding sides 126 and 127 of the magazine to pass the respective short vertical legs 101 and 102 of each fastener. The top wall 140 of housing H' is spaced above the horizontal top edges of the side walls 126 and 127 of the magazine far enough to pass the cross-piece 103 at the top of each fastener.

The operation of this second embodiment is essentially the same as the operation of the first embodiment, already described in detail.

I claim:

1. A machine for implanting fastener elements in the ground to hold an erosion cloth covering the ground comprising:

an upstanding hollow column having an opening extending up from its lower end for passing fastener elements into the interior of the column:

a magazine assembly operatively connected to said column at said opening, means in said magazine assembly for feeding fastener elements in succession from the magazine assembly through said opening and into said column;

guide means on said column for permitting only one fastener element at a time to be received inside the column;

a driver reciprocably mounted in said column for downward movement next to said opening from an upwardly retracted position above said opening to engage a fastener element in the column and push said fastener element down through the erosion cloth and into the ground and for return movement up to said upwardly retracted position;

spring means biasing said driver to its upwardly retracted position;

and a foot pedal on the outside of said column reciprocable up and down along the column and operatively connected to said driver to displace the latter downward when the user forces the foot pedal down;

said opening in the column being on one side of the column;

said magazine assembly extending away from said column on said one side thereof;

and said foot pedal being on the opposite side of said column.

2. A machine for implanting fastener elements in the ground to hold an erosion cloth covering the ground comprising:

an upstanding hollow column having an opening extending up from its lower end for passing fastener elements into the interior of the column;

a magazine assembly operatively connected to said column at said opening, means in said magazine assembly for feeding fastener elements in succession from the magazine assembly through said opening and into said column;

guide means on said column for permitting only one fastener element at a time to be received inside the column;

a driver reciprocably mounted in said column for downward movement next to said opening from an upwardly retracted position above said opening to engage a fastener element in the column and push said fastener element down through the erosion cloth and into the ground and for return movement up to said upwardly retracted position:

spring means biasing said driver to its upwardly retracted position;

a foot pedal on the outside of said column reciprocable up and down along the column and operatively connected to said driver to displace the latter downward when the user forces the foot pedal down;

and a handle operatively connected to said column and spaced above the bottom of said column by a distance enabling a person to grasp the handle while standing substantially erect with one foot on said foot pedal.

3. A machine according to claim 2 wherein:

said opening in the column is on one side of the column;

said magazine assembly extends away from said column on said one side thereof;

and said foot pedal is on the opposite side of said column.

4. An apparatus for implanting fastener elements of a predetermined thickness down through an erosion cover into the ground comprising:

a hollow vertical column with a bottom for engagement with the erosion cover on the ground;

a driver vertically reciprocable in said column between a retracted raised position spaced above said bottom of the column and a lowered position just above said bottom of the column;

a foot pedal connected to said driver and located outside said column for engagement from above by a person's foot to force said driver down from said retracted raised position to said lowered position;

a return spring in said column pulling said driver up to said retracted raised position;

a post extending up from said vertical column;

a handle on the upper end of said post at a height above the bottom of the column enabling the person to push the foot pedal down with one foot while standing substantially erect;

a magazine housing extending laterally from the lower end of said column at one side and having a hollow interior which opens into the hollow interior of said column;

a magazine disposed in said magazine housing and having means for slidably supporting a continuous series of fastener elements, each with a lower end a short distance above the ground;

a follower on said magazine engaging said series of fastener elements from behind;

spring means acting on said follower to urge said series of fastener elements toward said column;

and guide means inside said column adjacent said magazine housing for engagement by the leading fastener element in said series to position said leading fastener element vertically aligned with said driver for engagement by the driver from above when the driver is moved down from said retracted raised position to said lowered position, said guide means being spaced from said magazine housing a distance effective to permit only one fastener element at a time to be positioned in the path of said driver.

5. An apparatus according to claim 4, wherein:

said column has a flat back wall next to said magazine housing with a vertically elongated opening for passing a fastener element from said magazine housing into the interior of said column;

said guide means comprises a pair of plates attached respectively to said back wall of the column on opposite sides of said vertically elongated opening therein and presenting vertically coplanar flat abutment faces exposed at said opening and spaced from the inside of said back wall by slightly more than the thickness of a single fastener element.

6. An apparatus according to claim 5 wherein said back wall of the column has a thickness slightly greater than that of a single fastener element.

7. An apparatus according to claim 5 wherein said foot pedal and said magazine housing are located on opposite sides of said column.

8. An apparatus for implanting fastener elements of a predetermined thickness down through an erosion coyer into the ground comprising:

a hollow vertical column with a bottom for engagement with the erosion cover on the ground;

a driver vertically reciprocable in said column between a retracted raised position spaced above said bottom of the column and a lowered position just above said bottom of the column;

a foot pedal connected to said driver and located outside said column for engagement from above by a person's foot to force said driver down from said retracted raised position to said lowered position;

a return spring in said column pulling said driver up to said retracted raised position;

a post extending up from said vertical column;

a handle on the upper end of said post at a height above the bottom of the column enabling the person to push the foot pedal down with one foot while standing substantially erect;

a magazine housing extending laterally from the lower end of said column at one side and having a hollow interior which opens into the hollow interior of said column;

a magazine disposed in said magazine housing and having means for slidably supporting a continuous series of fastener elements, each with a lower end a short distance above the ground;

a follower on said magazine engaging said series of fastener elements from behind;

spring means acting on said follower to urge said series of fastener elements toward said column;

and guide means inside said column adjacent said magazine housing for engagement by the leading fastener element in said series to position said leading fastener element vertically aligned with said driver for engagement by the driver from above when the driver is moved down from said retracted raised position to said lowered position, said guide means being spaced from said magazine housing a distance effective to permit only one fastener element at a time to be positioned in the path of said driver;

said magazine being removably received in said magazine housing.

9. An apparatus according to claim 8, wherein said foot pedal and said magazine housing are located on opposite sides of said column.

10. An apparatus for implanting fastener elements of a predetermined thickness down through an erosion cover into the ground comprising:

a hollow vertical column with a bottom for engagement with the erosion cover on the ground;

a driver vertically reciprocable in said column between a retracted raised position spaced above said bottom of the column and a lowered position just above said bottom of the column;

a foot pedal connected to said driver and located outside said column for engagement from above by a person's foot to force said driver down from said retracted raised position to said lowered position;

a return spring in said column pulling said driver up to said retracted raised position;

a post extending up from said vertical column;

a handle on the upper end of said post at a height above the bottom of the column enabling the person to push the foot pedal down with one foot while standing substantially erect;

a magazine housing extending laterally from the lower end of said column at one side and having a hollow interior which opens into the hollow interior of said column;

a magazine disposed in said magazine housing and having means for slidably supporting a continuous series of fastener elements, each with a lower end a short distance above the ground;

a follower on said magazine engaging said series of fastner elements from behind;

spring means acting on said follower to urge said series of fastener elements toward said column;

and guide means inside said column adjacent said magazine housing for engagement by the leading fastener element in said series to position said leading fastener element vertically aligned with said driver for engagement by the driver from above when the driver is moved down from said retracted raised position to said lowered position, said guide means being spaced from said magazine housing a distance effective to permit only one fastener element at a time to be positioned in the path of said driver;

said column having a flat back well next to said magazine housing within a vertically elongated opening for passing a fastener element from said magazine housing into the interior of said column, said back wall of the column having a thickness slightly greater than that of a single fastener element;

said guide means comprising a pair of plates attached respectively to said back wall of the column on opposite sides of said vertically elongated opening therein and presenting vertically coplanar flat abutment faces exposed at said opening and spaced from the inside of said back wall by slightly more than the thickness of a single fastener element;

said magazine being removably received in said magazine housing.

11. An apparatus according to claim 10 wherein said foot pedal and said magazine housing are located on opposite sides of said column.

12. An apparatus according to claim 11 and further comprising:

means on said magazine for locking said follower retracted away from said column;

and wherein said magazine housing has an access opening adjacent said locking means enabling a user to manually release said follower from said locking means.

13. An apparatus for implanting fastener elements of a predetermined thickness down through an erosion cover into the ground comprising:

a hollow vertical column with a bottom for engagement with the erosion cover on the ground;

a driver vertically reciprocable in said column between a retracted raised position spaced above said bottom of the column and a lowered position just above said bottom of the column;

a foot pedal connected to said driver and located outside said column for engagement from above by a person's foot to force said driver down from said retracted raised position to said lowered position;

a return spring in said column pulling said driver up to said retracted raised position;

a post extending up from said vertical column;

a handle on the upper end of said post at a height above the bottom of the column enabling the person to push the foot pedal down with one foot while standing substantially erect;

a magazine housing extending laterally from the lower end of said column at one side and having a hollow interior which opens into the hollow interior of said column;

a magazine disposed in said magazine housing and having means for slidably supporting a continuous series of fastener elements, each with a lower end a short distance above the ground;

a follower on said magazine engaging said series of fastener elements from behind;

spring means acting on said follower to urge said series of fastener elements toward said column;

and guide means inside column adjacent said magazine housing for engagement by the leading fastener element in said series to position said leading fastener element vertically aligned with said driver for engagement by the driver from above when the driver is moved down from said retracted raised position to said lowered position, said guide means being spaced from said magazine housing a distance effective to permit only one fastener element at a time to be positioned in the path of said driver;

said column having a flat back wall next to said magazine housing with a vertically elongated opening for passing a fastener element from said magazine housing into the interior of said column;

said guide means comprising a pair of plates attached respectively to said back wall of the column on opposite sides of said vertically elongated opening therein and presenting vertically coplanar flat abutment faces exposed at said opening and spaced from the inside of said back wall by slightly more than the thickness of a single fastener element;

said magazine being removably received in said magazine housing.

14. An apparatus for implanting fastener elements of a predetermined thickness down through an erosion cover into the ground comprising:

a hollow vertical column with a bottom for engagement with the erosion cover on the ground;

a driver vertically reciprocable in said column between a retracted raised position spaced above said bottom of the column and a lowered position just above said bottom of the column;

a foot pedal connected to said driver and located outside said column for engagement from above by a person's foot to force said driver down from said retracted raised position to said lowered position;

a return spring in said column pulling said driver up to said retracted raised position;

a post extending up from said vertical column;

a handle on the upper end of said post at a height above the bottom of the column enabling the person to push the foot pedal down with one foot while standing substantially erect;

a magazine housing extending laterally from the lower end of said column at one side and having a hollow interior which opens into the hollow interior of said column;

a magazine disposed in said magazine housing and having means for slidably supporting a continuous series of fastener elements, each with a lower end a short distance above the ground;

a follower on said magazine engaging said series of fastener elements from behind;

spring means acting on said follower to urge said series of fastener elements toward said column;

and guide means inside said column adjacent said magazine housing for engagement by the leading fastener element in said series to position said leading fastener element vertically aligned with said driver for engagement by the driver from above when the driver is moved down from said retracted raised position to said lowered position, said guide means being spaced from said magazine housing a distance effective to permit only one fastener element at a time to be positioned in the path of said driver;

and means on said magazine housing for locking said follower retracted away from said column;

said magazine housing having an access opening enabling a user to manually release said follower from said locking means.

* * * * *